US012515770B2

(12) United States Patent
Godoy

(10) Patent No.: US 12,515,770 B2
(45) Date of Patent: Jan. 6, 2026

(54) BACKREST FOR A SCUBA DIVER WITH ADJUSTABLE SHOULDER STRAPS INTEGRATED WITH A LUMBAR STRAP

(71) Applicant: CRESSI-SUB S.P.A., Genoa (IT)

(72) Inventor: Carlos Alberto Godoy, Genoa (IT)

(73) Assignee: CRESSI-SUB S.P.A., Genoa (IT)

( * ) Notice: Subject to any disclaimer, the term of this patent is extended or adjusted under 35 U.S.C. 154(b) by 411 days.

(21) Appl. No.: 17/974,225

(22) Filed: Oct. 26, 2022

(65) Prior Publication Data

US 2023/0150627 A1 May 18, 2023

(30) Foreign Application Priority Data

Nov. 12, 2021 (IT) ..... 102021000028811

(51) Int. Cl.
*B63C 11/02* (2006.01)
*B63C 11/22* (2006.01)

(52) U.S. Cl.
CPC ..... *B63C 11/02* (2013.01); *B63C 2011/026* (2013.01); *B63C 2011/2281* (2013.01)

(58) Field of Classification Search
CPC ..... B63C 2011/026; B63C 2011/2281; B63C 11/02; A44B 11/04; A45F 3/14; A45F 2003/142
See application file for complete search history.

(56) References Cited

U.S. PATENT DOCUMENTS 3,033,431 A * 5/1962 Henderson ..... B63C 11/30 224/604
3,065,888 A 11/1962 Lande
3,219,242 A 11/1965 Reilly et al.
3,376,613 A * 4/1968 Lindblad ..... A44B 11/04 24/200
3,957,183 A * 5/1976 Gadberry ..... B63C 11/02 224/628

(Continued)

FOREIGN PATENT DOCUMENTS

WO 2010/141923 A2 12/2010

OTHER PUBLICATIONS

Italian Patent Application No. 102021000008921 filed Apr. 9, 2021 (with English translation of the claims).

*Primary Examiner* — Amber R Anderson
*Assistant Examiner* — Stacy N Lawson
(74) *Attorney, Agent, or Firm* — TROUTMAN PEPPER LOCKE LLP

(57) ABSTRACT

A backrest for a scuba diver comprising: a strap, having an upper right portion fitting around the diver's right shoulder, an upper left portion fitting around the diver's left shoulder and a lower portion fitting around the diver's abdomen, a right adjustment block between the upper right portion and the lower portion, and a left adjustment block between the upper left portion and the lower portion. Each of the adjustment blocks has a first pin engaged in a first loop of one end of the upper portion, a second pin engaged in a second loop of one end of the lower portion, a clamp clamping the lower portion of the strap to block the sliding of the end of the lower portion of the strap around the second pin, and a handgrip actuating the clamp between blocking and unblocking the sliding of the end of the lower portion of the strap around the second pin.

8 Claims, 2 Drawing Sheets

(56) References Cited

U.S. PATENT DOCUMENTS

| | | | | |
|---|---|---|---|---|
| 4,571,783 | A * | 2/1986 | Kasai | A44B 11/04 24/169 |
| 5,243,741 | A * | 9/1993 | Fudaki | A44B 11/04 24/200 |
| 5,651,166 | A * | 7/1997 | Lundstedt | A44B 11/04 24/200 |
| 6,582,157 | B1 * | 6/2003 | Takeuchi | B63C 11/22 441/92 |
| D523,920 | S | 6/2006 | Cresswell | |
| 2002/0111096 | A1 * | 8/2002 | Kawashima | A44B 11/125 441/116 |
| 2005/0086772 | A1 * | 4/2005 | Yoshiguchi | A44B 11/04 24/197 |
| 2006/0032028 | A1 * | 2/2006 | Takeuchi | B63C 11/22 24/197 |
| 2007/0022577 | A1 * | 2/2007 | Funo | A44B 11/04 297/483 |
| 2011/0099774 | A1 | 5/2011 | Pontaoe | |
| 2019/0082795 | A1 * | 3/2019 | Rossi | B63C 11/08 |

* cited by examiner

BACKREST FOR A SCUBA DIVER WITH ADJUSTABLE SHOULDER STRAPS INTEGRATED WITH A LUMBAR STRAP

CROSS REFERENCE TO RELATED APPLICATIONS

This application claims benefit of priority to Italian Patent Application No. 102021000028811, filed Nov. 12, 2021, the entire contents of which are hereby incorporated by reference.

FIELD

The present invention relates to a backrest for a scuba diver.

BACKGROUND

Backrests for scuba divers, that is, back support elements for one or more air cylinders for scuba diving, have been present on the market for some time in an extreme variety of shapes and sizes, both in a simple configuration and in a configuration integrated into a buoyancy control device (BCD), and are constrained to the scuba diver's body in various ways, generally with flexible straps.

It is well known that a plurality of straps and a corresponding plurality of connections and closures are generally interpreted by a scuba diver as an annoyance during donning, and even more so during doffing, which, under emergency conditions, may need to be simple and rapid.

As is known, there are backrests for scuba divers on the market that are provided with a single strap for constraining them to the diver's body and in which the strap, in a first upper part thereof, acts as a support for the weight of the cylinder(s) on the diver's shoulders and, in a second part thereof, suitably routed, allows a coupling of the two ends in an abdominal position.

Patent application IT 102021000008921 of the same Applicant discloses a backrest for a scuba diver in which the release of the single strap constraining in the abdominal position maintains the constraint of the backrest on the diver's shoulders.

However, such backrests for scuba divers of a known type, provided with a single strap for constraining them to the diver's body, imply that in the event that is necessary to adjust only the constraint on the shoulders the diver must proceed to tighten or loosen the constraint in the abdominal position, with evident inconvenience.

There are also known straps for the constraint on the diver's shoulders made with elements separate from the strap and/or straps in the abdominal position and connected to the latter by means of reciprocal adjustable connections: connections of this type, typically made of plastic materials, generally prove to be cumbersome and invasive for the diver, in particular in cave diving, where for safety reasons all the elements and accessories worn must be able to ensure utmost reliability against impacts with and entrapments between rocks or protrusions of any kind.

A need is thus felt to improve the structure of the known backrests for scuba diving.

SUMMARY

The technical task of the present invention, therefore, is to provide a backrest for a scuba diver that enables the aforementioned technical drawbacks of the prior art to be eliminated.

Within the scope of this technical task, one object of the invention is to provide a backrest for scuba divers provided with a single constraining strap that enables the constraints on the shoulders to be adjusted without acting on the constraint in the abdominal position.

Another object of the invention is to provide a backrest for scuba divers provided with a single constraining strap that has adjustment elements which are not cumbersome.

Yet a further object of the invention is to provide a backrest for scuba divers provided with a single constraining strap which enables a simple, effective and reversible adjustment of the constraints on the shoulders.

The technical task, as well as these and other objects, are achieved according to the present invention by providing a backrest for a scuba diver comprising: a shaped plate for supporting at least one air cylinder, said shaped plate comprising at least one lower right slide-through element and at least one lower left slide-through element; a strap fixed at the top to said shaped plate and slidable through said slide-through elements, comprising an upper right portion configured to fit around the scuba diver's right shoulder, an upper left portion configured to fit around the scuba diver's left shoulder and a lower portion configured to fit around the scuba diver's abdomen, characterised in that said strap comprises a right adjustment block between said upper right portion and said lower portion, and a left adjustment block between said upper left portion and said lower portion, wherein each of the adjustment blocks, the right one and the left one, has a first pin engaged in a first loop of one end of said upper portion of said strap, a second pin engaged in a second loop of one end of said lower portion of said strap, a clamp element for clamping said lower portion of said strap to block the sliding of said end of said lower portion of said strap around said second pin, and a handgrip element for actuating said clamp element between a position of blocking and a position of unblocking the sliding of said end of said lower portion of said strap around said second pin.

In one embodiment, each adjustment block has a bottom, two lateral walls, and a separating partition between said first pin and said second pin.

In one embodiment, the handgrip element is parallel to said bottom and the clamp element extends from said handgrip element in an angled direction in the direction of said second pin.

In one embodiment, the first pin and said second pin respectively have at least one or more protuberances for forcibly engaging respectively with said first loop of said upper portion and with said second loop of said lower portion of said strap.

In one embodiment, the actuation of said clamp element between a position of blocking and a position of unblocking the sliding of said end of said lower portion of said strap around said second pin is configured as a rotation of said block around said first pin.

Other features of the present invention are defined, moreover, in the subsequent claims.

BRIEF DESCRIPTION OF THE DRAWINGS

Additional features and advantages of the invention will become more apparent from the description of a first preferred but not exclusive embodiment of the backrest for a scuba diver according to the invention, illustrated by way of non-limiting example in the appended drawings, in which.

DETAILED DESCRIPTION

Figure 1:
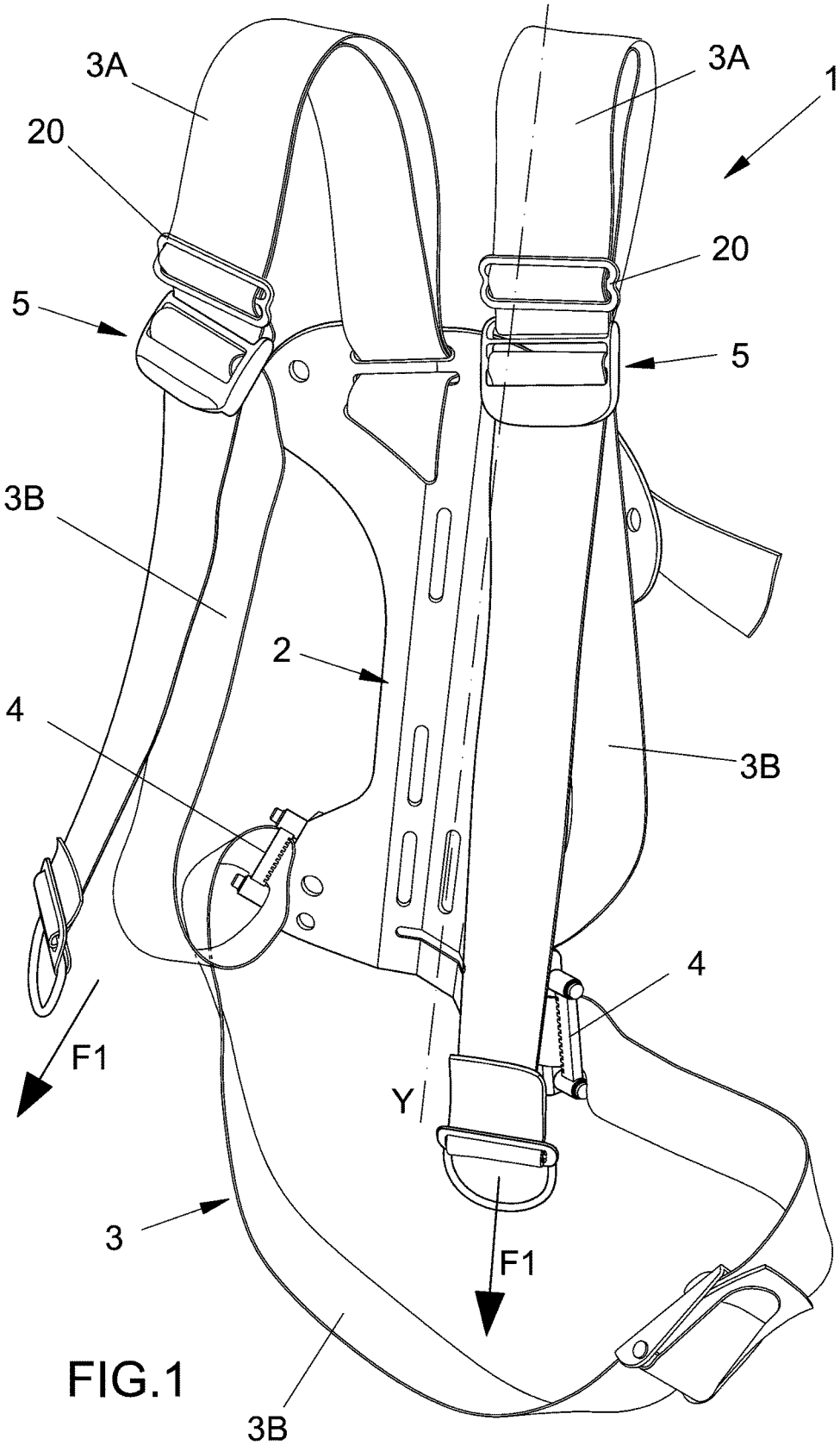
FIG. 1 shows an overall axonometric view of a backrest for a scuba diver.

The illustrative embodiments described in the detailed description and in the figure are not intended to be limiting.

Other embodiments may be used and other modifications may be introduced without departing from the spirit or the scope of the subject matter presented herein.

The aspects of the present description, as generally described in the present context and illustrated in the figures, may be arranged, replaced, combined and designed in a wide variety of different configurations, which are all explicitly envisaged and are part of this description.

With reference to the above-mentioned figures, they show a backrest for a scuba diver denoted in its entirety by the reference number 1.

The backrest is typically symmetrical with respect to a vertical axis Y; in the figures, similar reference numbers typically identify similar components, unless the context indicates otherwise.

The backrest for a scuba diver 1 comprises a shaped plate 2 for supporting at least one air cylinder, not shown in the figures.

The shaped plate 2 comprises at least one lower right slide-through element 4 and a lower left slide-through element 4; a strap 3 is fixed to the shaped plate 2 and slides through the slide-through elements 4.

The strap 3 comprises at least one upper right portion 3A configured to fit around the scuba diver's right shoulder and symmetrically an upper left portion 3A configured to fit around the scuba diver's left shoulder; the strap 3 comprises a lower portion 3B configured to fit around the scuba diver's abdomen.

Advantageously, according to the present invention, the backrest 1 comprises a right adjustment block 5 between the upper right portion 3A and the lower portion 3B of the strap 3; symmetrically, the backrest 1 comprises a left adjustment block 5 between the upper left portion 3A and the lower portion 3B of the strap 3.

Each adjustment block 5 has a width L that is greater than the width of the lower portion 3B of the strap 3 and a height H in the direction of the longitudinal axis of the lower portion 3B.

Each of the adjustment blocks 5, the right one and the left one, has a first pin 6 engaged in a first loop 7 of one end of the corresponding upper portion 3A of the strap 3, and a second pin 8 engaged in a second loop 9 of a corresponding end of the lower portion 3B of the strap 3.

The end of the upper portion 3A is blocked from sliding over the first pin 6 by an adjustable blocking means 20. As an alternative to the adjustable blocking means 20, a stitched seam can be provided between the ends of the first loop 7, whereby the end of the upper portion 3A is blocked from sliding over the first pin 6.

Conveniently, each adjustment block 5 has at least one clamp element 10 for clamping the lower portion 3B of said strap 3 to block the sliding of the end of the lower portion 3B of the strap 3 around the second pin 8.

Advantageously, each adjustment block 5 has at least one handgrip element 11 for actuating the clamp element 10 between a position of blocking and a position of unblocking the sliding of the end of the lower portion 3B of the strap 3 around the second pin 8.

Each adjustment block 5 is made up of a body having a bottom 51 and two opposing lateral walls 52, 53 that delimit the adjustment block 5 in the width L.

The bottom 51 and the lateral walls 52, 53 delimit a cavity of the body of the adjustment block 5.

The first pin 6 and the second pin 8 extend parallel in said cavity in the direction of the width L between the two lateral walls 52, 53.

Also positioned in that cavity there is a separating partition 54 between the first pin 6 and the second pin 8.

The separating partition extends transversely from the bottom 51. The handgrip element 11 is made up of a shaped edge of the bottom 51 that extends in the direction of the width L and delimits an opening 55 for the introduction of the diver's fingers in the cavity of the body of the block 5 for the actuation of the clamp element 10.

The handgrip element 11 and the first pin 6 extend along opposite edges of the bottom 51 that delimit the adjustment block 5 in the width L.

The clamp element 10 extends in the cavity of the body of the block 5 from the handgrip element 11 in an angled direction in the direction of the second pin 8.

The bottom 51 has, on one side of the separating partition 54, a first slot 56 that extends in the direction of the width L for the passage of the first loop 7 wrapped around the first pin 6 and, on the other side of the separating partition 54, a second slot 57 and a third slot 58 that extend in the direction of the width L and are interposed between the separating partition 54 and the clamp element 10 for the passage of the second loop 9 wrapped around the second pin 8.

Conveniently, both the first pin 6 and the second pin 8 have at least one or more protuberances 60*i*, 80*i* for engaging, in a blocked position, with the first loop 7 of the upper left portion and with the second loop 9 of the lower portion 3B of the strap 3, respectively.

Advantageously, the adjustment block 5 is a monolithic piece, for instance but not necessarily made of thermoplastic polymeric resins.

From an operational viewpoint, the actuation of the clamp element 10 between a position of blocking and a position of unblocking the sliding of the end of the lower portion 3B of the strap 3 around the second pin 8 is configured as a rotation of the block 5 around the first pin 6.

The operation of a backrest for a scuba diver according to the invention appears clear from what is described and illustrated and, in particular, is substantially the following.

The diver puts on the backrest 1, fitting the upper portions 3 A of the strap 3 around his shoulders and the portion 3B in the abdominal position; by adjusting the portion 3B by sliding it through the lower slide-through elements 4 he secures the backrest in a first position, the dorsal position.

Figure 3B:
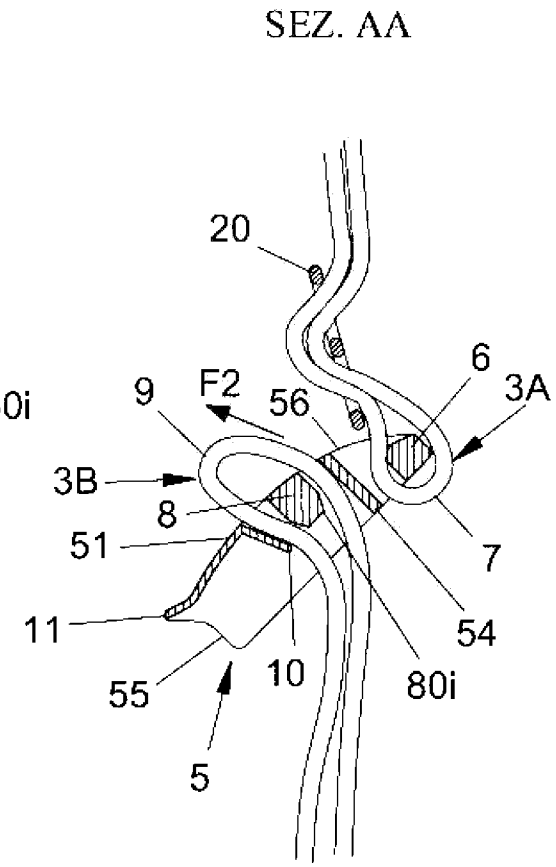
FIGS. 3 A and 3 B show a detailed view of a section AA of the adjustment block, respectively in a position of blocking and a position of unblocking the sliding of the lower end of the strap.
Figure 3A:
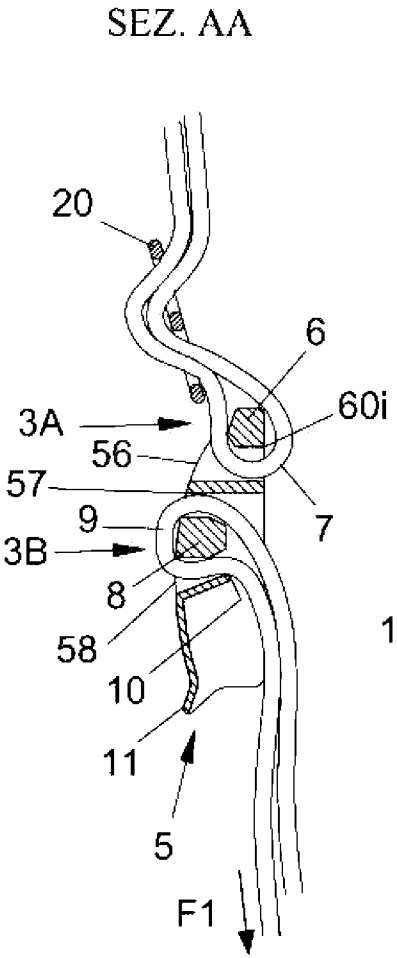
Figure 2:
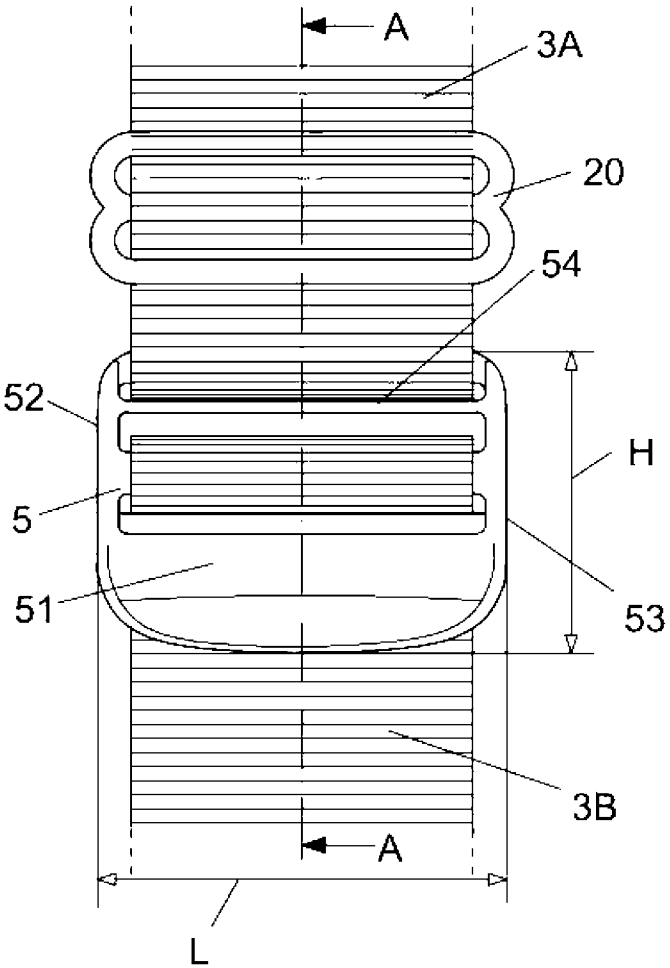
FIG. 2 shows a detailed view of the strap engaged in the adjustment block.

As illustrated in FIG. 3A, the first loop 7 of the end of the upper portion 3 A of the strap 3 is engaged in the first pin 6 of the block 5 and is blocked from sliding by the blocking means 20.

The adjustment block 5 is in the blocking position: the second loop 9 of the end of the lower portion 3B of the strap 3 is engaged in the second pin 8 of the block 5 and is blocked from sliding by the clamp element 10 in the blocking position that counters the tension F1 on the lower portion of the strap 3B.

As illustrated in FIG. 3B, for any adjustment of the strap 3 at the opposite ends of the lower portion of strap 3B, the diver will move the adjustment block 5 into the unblocking position.

The diver will act on the handgrip 11 and rotate the block 5 around the first pin 6; during the rotation, the clamp element 10 will be parallel to the lower portion of the strap 3B engaged around the second pin 8 and enable the consequent sliding thereof at a tension F2.

Once the adjustment has been obtained, the diver, by acting on the handgrip 11 in a rotation opposite the unblocking one, will bring the clamp element 10 back to the forced engagement of the lower portion of strap 3B against the second pin 8, and hence the adjustment block 5 into the blocking position at the desired length of constraint of the strap 3 around his body.

It has in practice been ascertained that a backrest for a scuba diver provided with a single constraining strap according to the invention is particularly advantageous, as it enables the constraints on the shoulders to be adjusted without having to intervene on the constraint in the abdominal position.

Another advantage of the invention is that of providing a backrest for a scuba diver provided with a single constraining strap having adjustment elements that are not cumbersome.

Yet a further advantage of the invention is that of providing a backrest for a scuba diver provided with a single constraining strap which enables a simple, effective and reversible adjustment of the constraints on the shoulders.

A backrest for a scuba diver thus conceived is susceptible of numerous modifications and variants, all falling within the scope of the inventive concept, as defined by the claims; moreover, all the details may be replaced with technically equivalent elements.

The materials used, as well as the dimensions, may in practice be any whatsoever according to needs and the state of the art.

What is claimed is:

1. A backrest for a scuba diver, the backrest comprising:

a shaped plate supporting at least one air cylinder, said shaped plate comprising a lower right slide-through element and a lower left slide-through element, said lower right slide-through element comprising a single aperture and said lower left slide-through element comprising a single aperture;

a right strap fixed at a top of said shaped plate, the right strap comprising an upper right portion configured to fit around a right shoulder of the scuba diver, a lower right portion configured to fit around an abdomen of the scuba diver, and a right adjustment block between said upper right portion and said lower right portion, the right adjustment block being a monolithic piece and comprising:

a first pin comprising one or more protuberances for engaging in a blocked position with a first loop of one end of said upper right portion of said right strap, a second pin comprising one or more protuberances for engaging in a blocked position with a second loop of one end of said lower right portion of said right strap, a clamp element clamping said lower right portion of said right strap to block the sliding of said end of said lower right portion of said right strap around said second pin, and a handgrip element actuating said clamp element between a position of blocking and a position of unblocking the sliding of said end of said lower right portion of said right strap around said second pin; and a left strap fixed at the top of said shaped plate, the left strap comprising an upper left portion configured to fit around a left shoulder of the scuba diver, a lower left portion configured to fit around the abdomen of the scuba diver, and a left adjustment block between said upper left portion and said lower left portion, the left adjustment block being a monolithic piece and comprising:

a first pin comprising one or more protuberances for engaging in a blocked position with a first loop of one end of said upper left portion of said left strap, a second pin comprising one or more protuberances for engaging in a blocked position with a second loop of one end of said lower left portion of said left strap, a clamp element clamping said lower left portion of said left strap to block the sliding of said end of said lower left portion of said left strap around said second pin, and a handgrip element actuating said clamp element between a position of blocking and a position of unblocking the sliding of said end of said lower left portion of said left strap around said second pin, wherein said lower right portion of said right strap passes through said single aperture of the lower right slide-through element of said shaped plate only once and said lower left portion of said left strap passes through said single aperture of the lower left slide-through element of said shaped plate only once to secure the backrest in a first position, the first position being a dorsal position; and wherein said single aperture of the lower right slide-through element comprises a first plurality of protrusions directed inward toward said lower right portion of said right strap and said single aperture of the lower left slide-through element comprises a second plurality of protrusions directed inward toward said lower left portion of said left strap.

2. The backrest for a scuba diver according to claim 1, wherein each clamp element extends from said handgrip element in an angled direction in the direction of said second pin.

3. The backrest for a scuba diver according to claim 1, wherein the actuation of said clamp element of the right adjustment block between a position of blocking and a position of unblocking the sliding of said end of said lower right portion of said right strap around said second pin is configured as a rotation of said right adjustment block around said first pin, and wherein the actuation of said clamp element of the left adjustment block between a position of blocking and a position of unblocking the sliding of said end of said lower left portion of said left strap around said second pin is configured as a rotation of said left adjustment block around said first pin.

4. The backrest for a scuba diver according to claim 1, wherein said end of said upper right portion of the right strap is blocked from sliding over said first pin of the right adjustment block by a right blocking means, and wherein said end of said upper left portion of the left strap is blocked from sliding over said first pin of the left adjustment block by a left blocking means.

5. The backrest for a scuba diver according to claim 1, wherein each adjustment block comprises a bottom and two opposite side walls which delimit in width said adjustment block, said bottom and said opposite side walls delimiting a cavity in a body of said adjustment block.

6. The backrest for a scuba diver according to claim 5, wherein said first pin and said second pin of each adjustment block extend in parallel in said cavity in the direction of said width between said opposite side walls.

7. The backrest for a scuba diver according to claim 6, wherein a separating partition is positioned in said cavity between said first pin and said second pin.

8. The backrest for a scuba diver according to claim 5, wherein said handgrip element of each adjustment block is formed by a shaped edge of said bottom which extends in the direction of said width and delimits an opening for the introduction of one or more fingers of the scuba diver in said cavity of said body of said adjustment block for the actuation of said clamp element.

* * * * *